US006142867A

United States Patent [19]

Lee et al.

[11] Patent Number: 6,142,867

[45] Date of Patent: Nov. 7, 2000

[54] INDICATING APPARATUS FOR A DAMPER OPENING/CLOSING APPARATUS OF AN AIR DIFFUSER

[75] Inventors: Dae Woo Lee; Myung Sig Park, both of Seoul; Jung Chang Lee, Kyungki-do, all of Rep. of Korea

[73] Assignee: Hyundai Enginerring & Construction Co., Ltd., Seol, Rep. of Korea

[21] Appl. No.: 08/923,555

[22] Filed: Sep. 4, 1997

[30] Foreign Application Priority Data

Sep. 4, 1996 [KR] Rep. of Korea ..... 96-38211

[51] Int. Cl.[7] ..... F24F 13/10

[52] U.S. Cl. ..... 454/326; 137/556.3; 454/300; 454/311; 454/327; 454/322

[58] Field of Search ..... 454/299, 300, 454/311, 326, 327, 336, 322; 251/228; 137/556, 556.3

[56] References Cited

U.S. PATENT DOCUMENTS

| | | | |
|---|---|---|---|
| 657,049 | 8/1900 | Auer | 454/327 |
| 1,659,880 | 2/1928 | Kauffman | 454/326 X |
| 2,105,681 | 1/1938 | Armstrong | 137/556.3 X |
| 4,893,582 | 1/1990 | Kalamon et al. . | |

FOREIGN PATENT DOCUMENTS

| | | | |
|---|---|---|---|
| 1291573 | 3/1962 | France | 454/322 |
| 30158 | 7/1884 | Germany | 454/326 |
| 613842 | 5/1935 | Germany | 137/556.3 |
| 686666 | 1/1953 | United Kingdom | 454/311 |
| 686738 | 1/1953 | United Kingdom | 454/311 |

*Primary Examiner*—Harold Joyce
*Attorney, Agent, or Firm*—Kile, McIntyre, Harbin & Lee; Eugene M. Lee

[57] ABSTRACT

An opening/closing apparatus of a damper for adjusting a blowing amount of air out of an air diffuser comprises a case mounted at the center of the diffuser in a predetermined size and shape and having an indicating scale portion to be properly positioned at the front surface thereof; a rotating shaft passed through the center portion of the case and extended in a predetermined length out of the case; a rotating manipulation portion including a knob integrally fixed to one end of the rotating shaft; and an indicating operation portion cooperated with the rotating manipulation portion to enable an indicator to direct the indicating scale, thereby confirming the exact opening or closing degree of the damper.

1 Claim, 7 Drawing Sheets

INDICATING APPARATUS FOR A DAMPER OPENING/CLOSING APPARATUS OF AN AIR DIFFUSER

BACKGROUND OF THE INVENTION

The invention is related to providing an opening/closing apparatus for enabling a damper to be opened/closed in order to adjust a blowing amount of an air diffuser, which is installed on the ceiling for cooling/warming room.

PRIOR ART

An air conditioner system have been used to be provided in larger buildings or offices to keep the temperature and humidity of room in an optimization state. The air conditioner system is generally configured so that conditioned air is blown out of an air diffuser mounted on the ceiling of room, passing ducts from an air conditioner. The air diffuser includes a damper for adjusting a blowing amount of air supplied thereto according to the degree of its opening/closing in order to properly air-condition room. Then, the opening/closing state of the damper influences a lot on the total air pressure of the air conditioner system even in one air diffuser. To it, the dampers must be set at a predetermined opening or closing degree not to give a bad effect on the air pressure of the air conditioner system. A typical method of setting the opening or closing degree of the damper comprises steps of measuring a blowing amount of air from each of all diffusers mounted in room by using a gauge and setting the opening or closing degree of each of the dampers based on the measured results. But, it has an problems in that it is difficult to check the opening or closing degree of the damper to be operated, because the damper is mounted in the ceiling to be hidden by an air diffusing plate. So, the blowing amount of air from the diffuser can not be determined by a naked eye.

Herein, it is known that the opening or closing degree of the damper must be set through the repeated operation, in a manner that the damper is first opened or closed by an auxiliary level dependent on the judgement of a worker, the blowing amount of air discharged out of the air diffuser is measured by the gauge and then the opening or closing degree of the damper is again adjusted. Furthermore, the opening or closing operation of all dampers installed in rooms of a building must be performed. It requires a lot of working time and labor power following a huge expense in adjusting/setting the opening or closing degree of the dampers mounted everywhere in a building. Because of it, the efficiencies of the management and operation and the economics of the air conditioner system are being reduced.

In order to resolve these problems an object of the invention is to provide an opening/closing apparatus for enabling the opening or closing degree of the damper to be confirmed through an indicating scale and a blowing amount of air discharged out of a diffuser to be adjusted, thereby reducing a lot of working time and labor power in adjusting/setting the opening or closing degree of the damper. It enhances the efficiencies of the management and operation and the economics of the air conditioner system.

SUMMARY OF THE INVENTION

Accordingly, the invention provides an opening/closing apparatus of a damper for adjusting a blowing amount of air out of an air diffuser, comprising a case mounted at the center of the diffuser in a predetermined size and shape and having an indicating scale portion to be properly positioned at the front surface thereof; a rotating shaft passed through the center portion of the case and extended in a predetermined length out of the case; a rotating manipulation portion including a knob integrally fixed to one end of the rotating shaft, and an indicating operation portion cooperated with the rotating manipulation portion to enable an indicator to direct the indicating scale, thereby confirming the exact opening or closing degree of the damper.

BRIEF DESCRIPTION OF THE DRAWINGS

The invention now will be described in detail with reference to the accompanying drawings, in which.

DETAILED DESCRIPTION OF THE INVENTION

Figure 1:
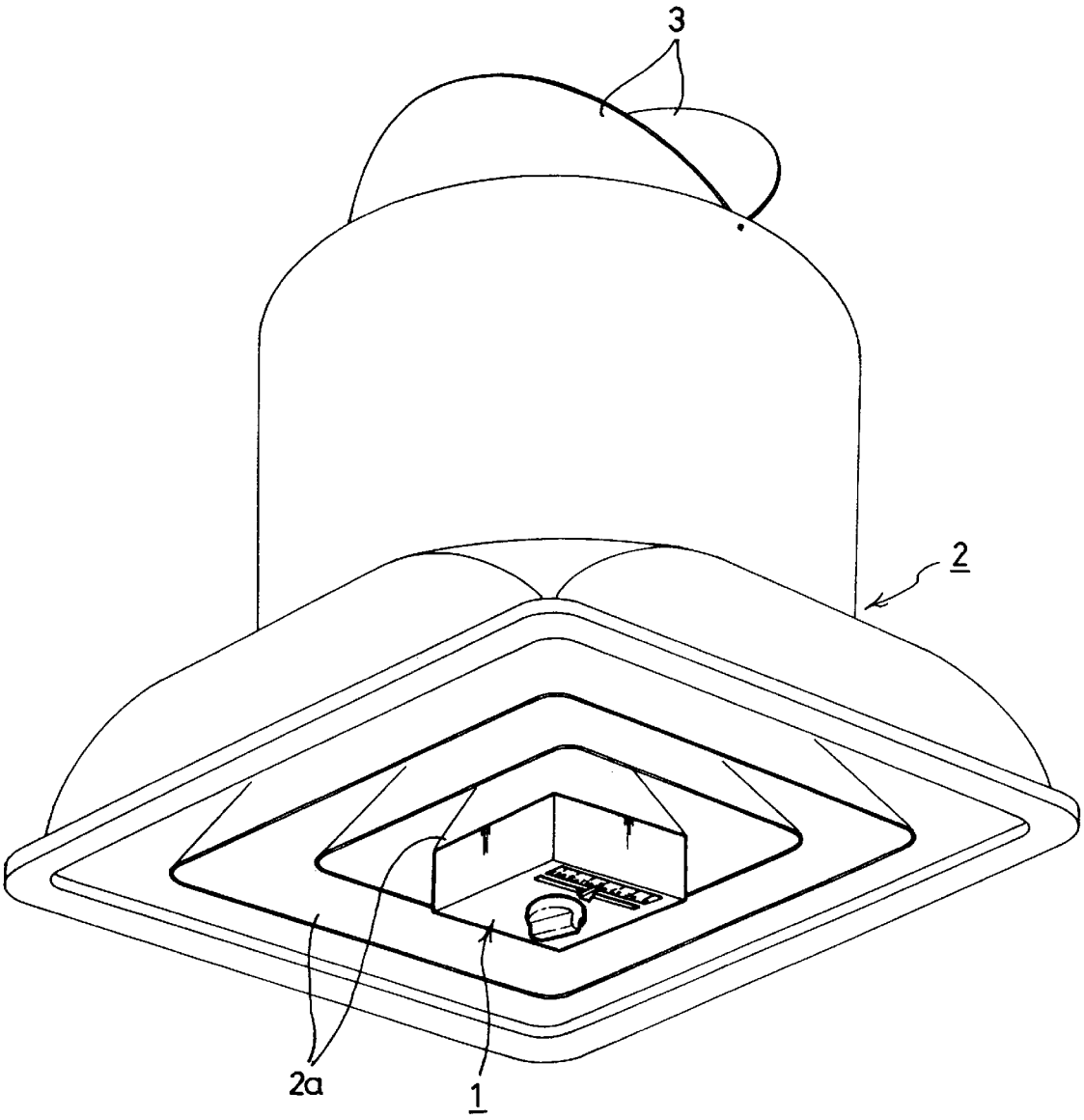
FIG. 1 is a perspective view illustrating an air diffuser provided with a damper opening/closing apparatus according to the principal of the inventions.
Figure 2:
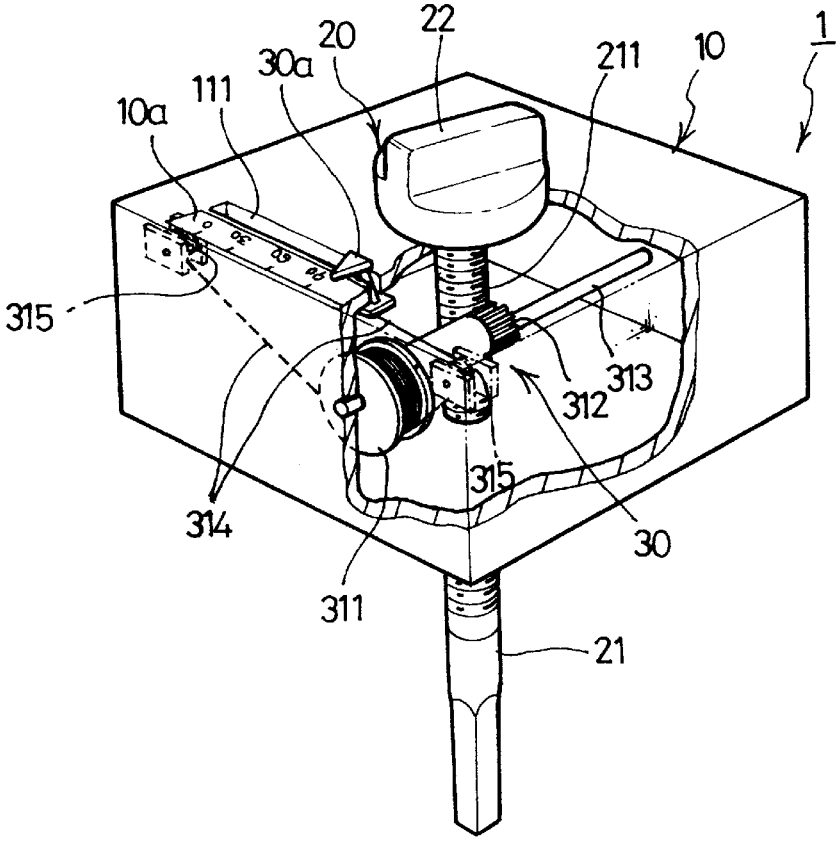
FIG. 2 is a perspective view illustrating the damper opening/closing apparatus of a first embodiment according to the invention.
Figure 3:
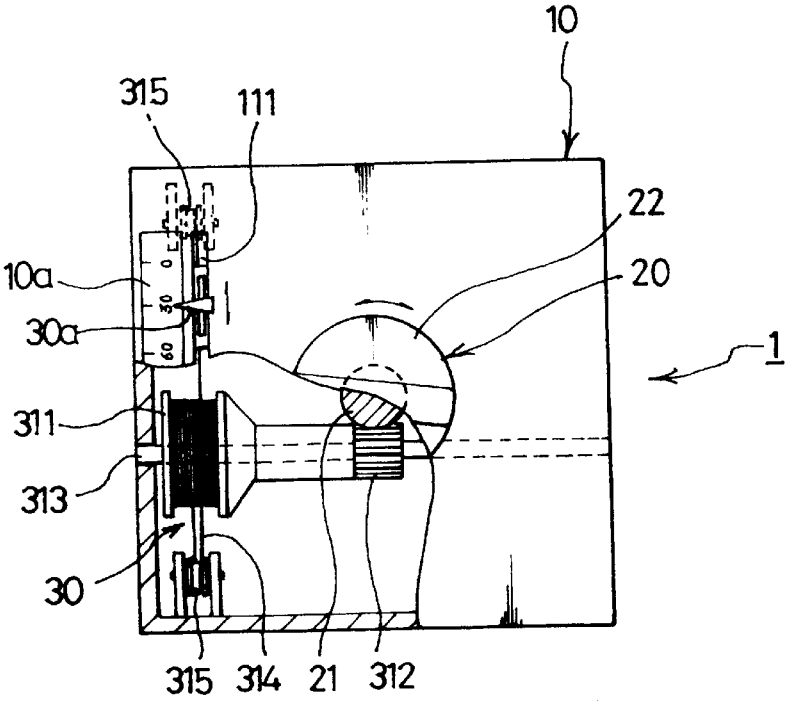
FIG. 3 is a plane view of FIG. 2 cut in part.
Figure 4:
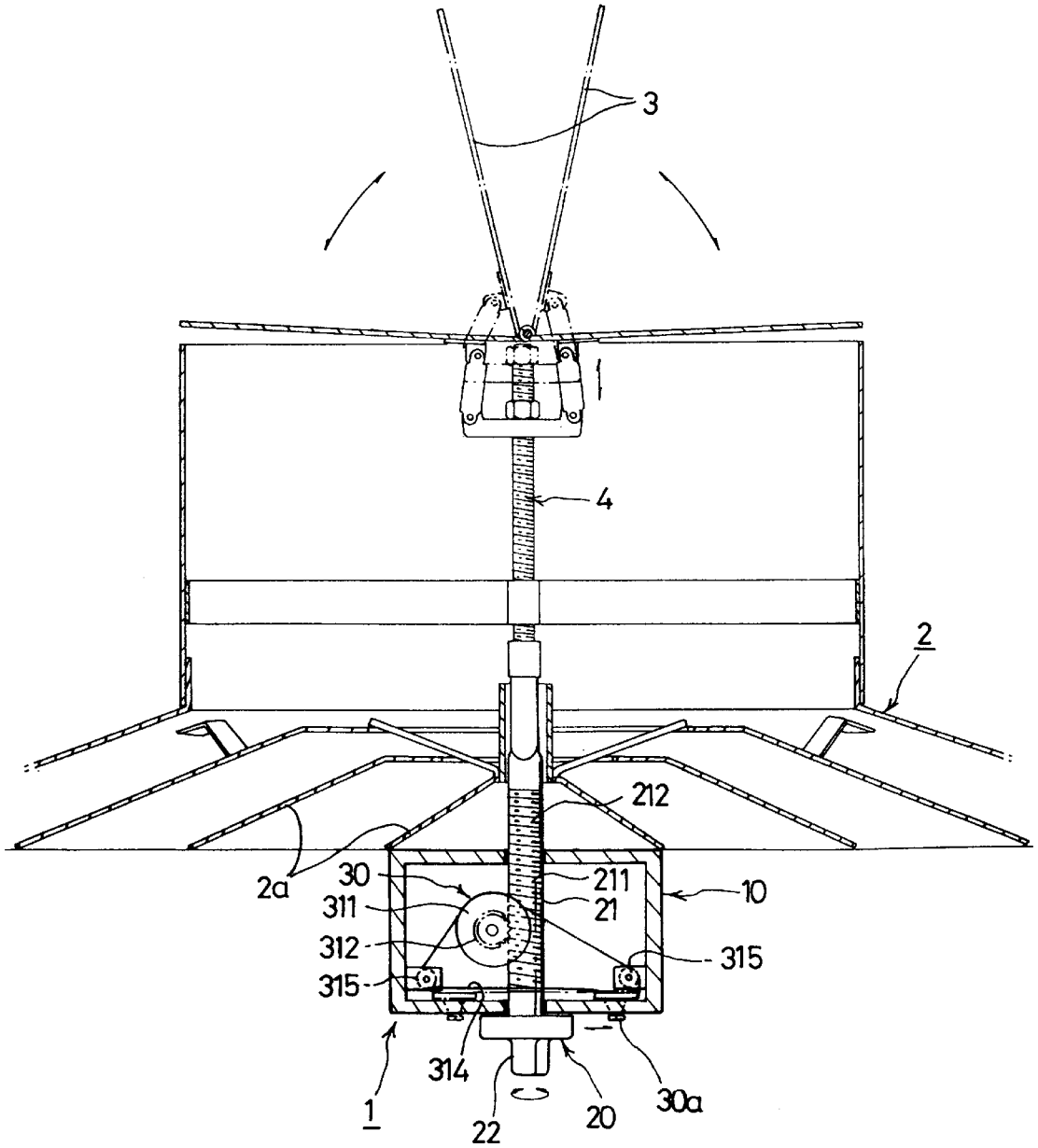
FIG. 4 is a cross sectional view illustrating the operating of the first embodiment according to the invention.

An opening/closing apparatus 1 of a damper 3 for adjusting a blowing amount of air out of an air diffuser 2 comprises a case 10 mounted at the center of the diffuser 2 in a predetermined size and shape and having an indicating scale portion 10*a* to be properly positioned at the front surface thereof; a rotating shaft 21 passed through the center portion of the case 10 and extended in a predetermined length out of the case 10; a rotating manipulation portion 20 including a knob 22 integrally fixed to one end of the rotating shaft 21; and an indicating operation portion 30 cooperated with the rotating manipulation portion 20 to enable an indicator 30*a* to direct the indicating scale 10*a,* thereby confirming the exact opening or closing degree of the damper 3. Therefore, the damper opening/closing apparatus 1 is mounted at the front center of a diffusing plate 2*a* to perform the opening/closing of the damper 3. The damper 3 is opened or closed as the knob 22 is forcedly rotated. At that time, the indicator 30*a* of the indicating operation portion 30 is cooperated with the rotating manipulation portion 20 to enable users to confirm the opening or closing degree of the damper 3 by a naked eye. It facilitates the opening/closing operating of the damper 3.

Referring to FIGS. 1 to 4, a first embodiment of this invention is now described, an indicating scale portion 10*a* is formed on the front surface of the case 10 in parallel to a guide hole 111 which is perforated in a longitudinal direction to receive an indicator 30*a*. A rotating manipulation portion 20 includes a rotating shaft 21 having a threaded portion 211 formed around the outer peripheral portion thereof in a predetermined length, a knob 22 fixed to one end of the rotating shaft 21 and an extending portion 212 passing through the case 10 and connected to an operating rod 4 of the damper 3. The indicating operation portion 30 includes a pinion gear 312 rotatably shafted to a longitudinal fixing axis 313, which is formed on one side surface of the case 10 a winding drum 311 integrally fixed to the pinion gear 311. The pinion gear 312 is engaged with the threaded portion 211 to be cooperated with the rotating shaft 211. The pinion gear also 312 includes a string 313 wound around the winding drum 311 and a pair of guide rollers 315 in turn in an endless track shape. The guide rollers 315 are respectively mounted in an opposite direction to each other on the one inner surface of the case 10. The indicator 30*a* is fixed at a predetermined position 314 between the rollers 315 on the string 313. As the string 313 is moved by the rotation of the pinion gear 311, the indicator 30*a* directs the scale on the indicating scale portion 10*a* with being inserted into the guide hole 111. The opening/closing apparatus 1 is mounted to the diffusing plate 2*a* at the center of the diffuser 2 and includes the rotating shaft 21, the end portion of which is passed through the case 10 and connected to the operating rod 4 to open or close the damper 3.

Therefore, as the know 22 is manually rotated, the damper 3 connected in turn to the rotating shaft 21 and the operating rod 4 is operated to open or close the diffuser 2. At that time, the pinion gear 312 engaged with the rotating shaft 21 is rotated together with the winding drum 311, so the string 314 is wound around the winding drum 311 to move the indicator 30*a* fixed at the position 315 between guide rollers 315. In other words, when the right side of the string 314 is pulled by the rotating drum 311, the other side portion is unwound therefrom to force the indicator 30*a* to direct the scale on the indication scale portion 10*a*. Herein it is known that the invention enables a worker to confirm the opening or closing degree of the damper 3 by the scale value during the operating of the knob 22.

Figure 5:
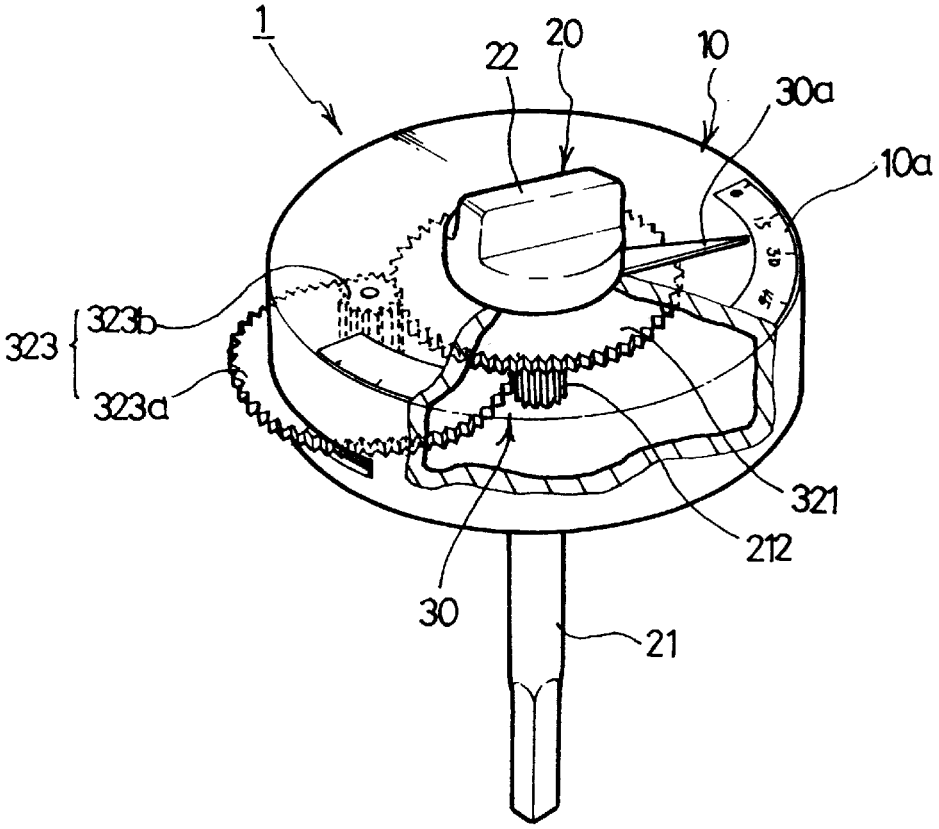
FIG. 5 is a perspective view illustrating the damper opening/closing apparatus of a second embodiment according to the invention.
Figure 6:
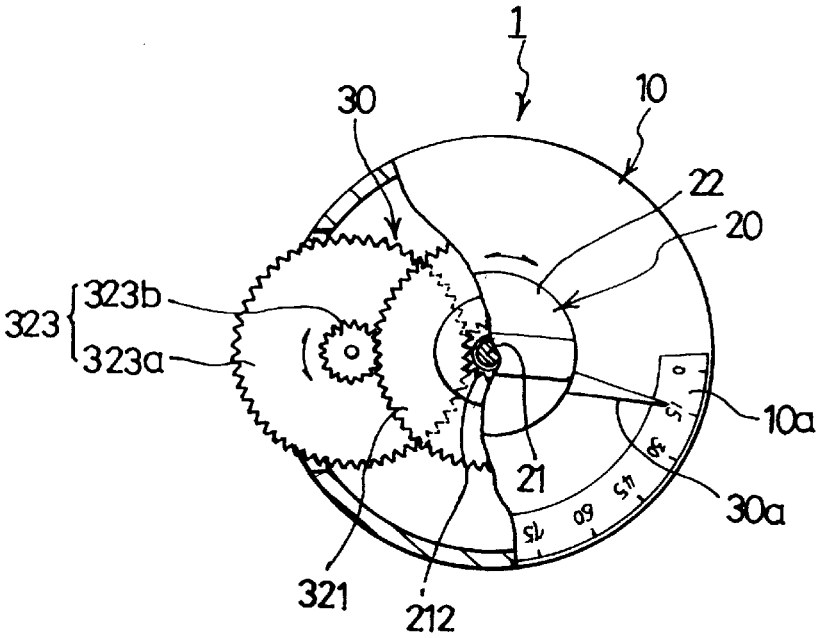
FIG. 6 is a plane view of FIG. 5 cut in part.
Figure 7:
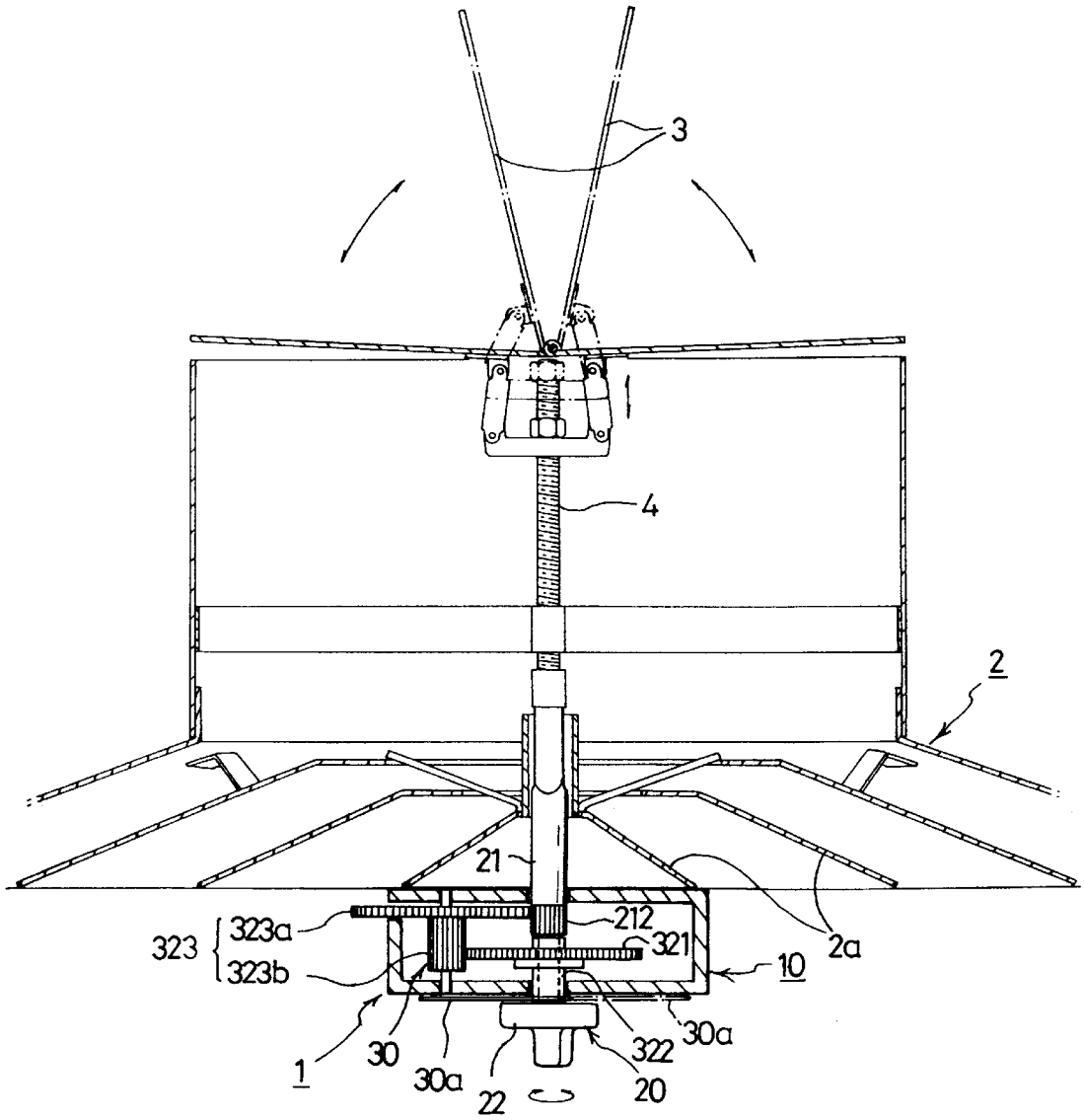
FIG. 7 is a cross sectional view illustrating the operating of the second embodiment according to the invention.

Referring to FIGS. 5–7, a second embodiment of the invention is now described. A case 10 is in the form of a cylinder and includes an indicating scale portion 10*a* formed in an arc shape adjacent to the outer peripheral of the front surface thereof. A rotating manipulation portion 20 includes a rotating shaft 21 having an operating gear portion 212 integrally formed on the outer peripheral thereof, a knob 22 fixed to one end of the rotating shaft 21 and an extending portion 212 passing through the case 10 and connected to an operating rod 4 of the damper 3. An indicating operation portion 30 includes an engaging gear 321 of a larger diameter rotatably engaged with the operating gear 212, shaft bearing 322 having a center portion projected from the front surface of the case 10 and an outer portion positioned adjacent to the front surface and an indicator 30*a* coupled with the outer portion of the shaft bearing 322. A driven wheel 323 is mounted in the case 10 and includes first and second plain gears 323*a* and 323*b* integrated to each other. The first and second plain gears 323*a* and 323*b* each has a larger diameter and a smaller diameter to be engaged with the operating gear 212 and the engaging gear 323. As the engaging gear 321 is rotated by the rotation of the driven wheel 323 to be cooperated with the operating gear 212 the indicator 30*a* is rotated by the shaft bearing 322 thereby to direct the scale on the indicating scale portion 10*a*.

Therefore, as the knob 22 is manually rotated, the damper 3 connected in turn to the rotating shaft 21 and the operating rod 4 is operated to open or close the diffuser 2. At that time, the operating gear 212 of the rotating shaft 21 is rotated, and thus the driven wheel 32 is rotated along with the first plain gear 323 while the engaging gear 321 engaged with the second plain gear 323*b* is rotated, the indicator 30*a* coupled to the outer portion of the shaft bearing 322 is rotated in proportion to the gear ratio of the driven gear 323 and the engaging gear 321, thereby forcing the indicator 30*a* to direct the scale on the indication scale portion 10*a*. Herein it is known that the invention enables a worker to confirm the opening or closing degree of the damper 3 by the scale value during the operating of the know 22.

Figure 8:
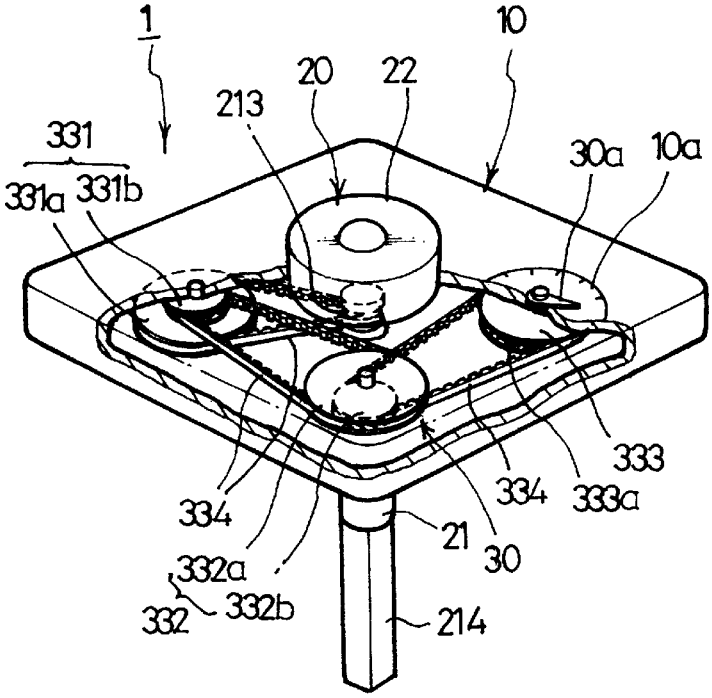
FIG. 8 is a perspective view illustrating the damper opening/closing apparatus of a third embodiment according to the invention.
Figure 9:
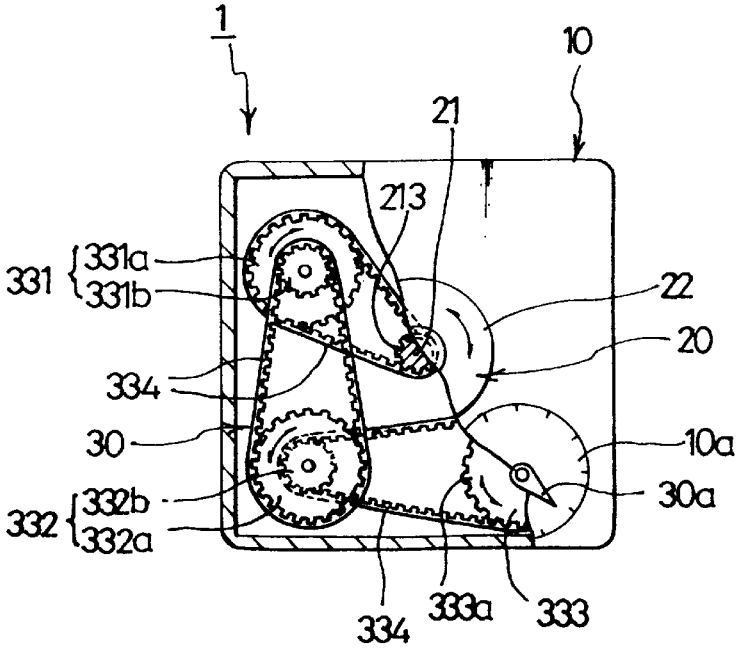
FIG. 9 is a plane view of FIG. 8 cut in part.
Figure 10:
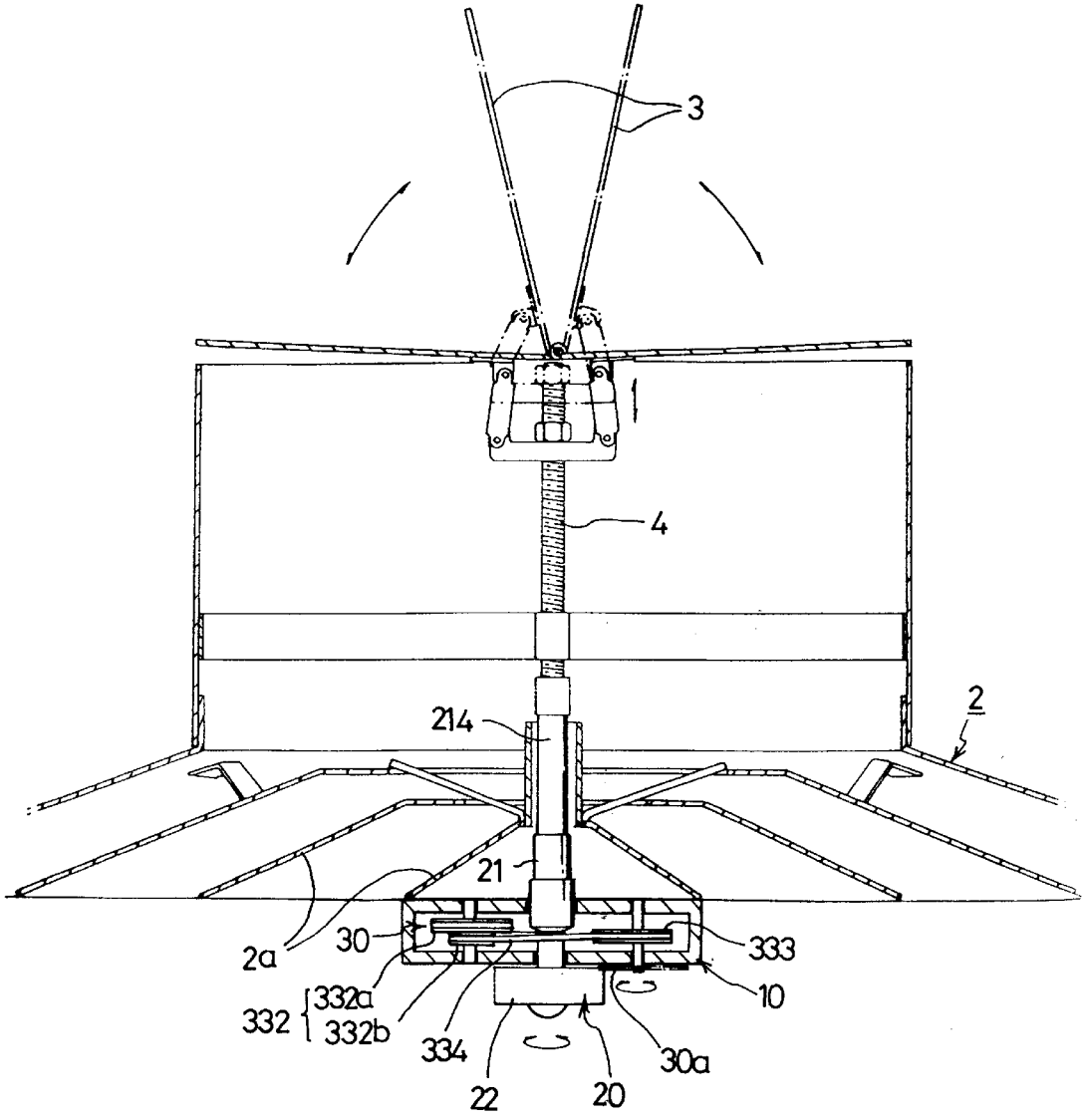
FIG. 10 is a cross sectional view illustrating the operating of the second embodiment according to the invention.

Referring to FIGS. 8 to 10, a third embodiment of the invention is now described. An opening/closing apparatus of a damper 3 comprises a case 10 in the form of a cube cylinder and includes an indicating scale portion 10 formed in a circular adjacent to the outer corner of the front surface thereof. A rotating manipulation portion 20 includes a rotating shaft 21 having an operating gear portion 213 integrally formed on the outer peripheral thereof, a knob 22 fixed to one end of the rotating shaft 21 and an extending portion 214 passing through the case 10 and connected to an operating rod 4 of the damper 3. An indicating operation portion 30 comprises a first wheel 331 mounted adjacent to the operating gear 21, a third wheel 332 mounted in a line relative to the first wheel 331 and a third wheel 333 mounted in a line relative to the second wheel, in which the first wheel 331 includes a first plain gear 31*a* of a larger diameter and a second plain 331*b* of a smaller diameter, which are integrated to each other, and the second wheel 332 also includes a first plain gear 332*a* of a larger diameter and a second plain 332*b* of a smaller diameter, which are integrated to each other. Thus, the operating gear 213 is connected in turn to the first wheel 331 and the second wheel 332 by means of timing belts 334. And, the second wheel 332 is connected to the third wheel 333 by means of the timing belt 334, in which the third wheel 333 is coupled at the axis to the indicator 30 positioned on the outer surface of the case 10 includes a gear 333*a* formed on the outer peripheral thereof. As the third wheel 333 is rotated by the subsequent operation of the operating gear 213, the first wheel 331 and the sound wheel 332, the indicator 30*a* is rotated thereby to direct the scale on the indicating scale portion 10*a*.

Therefore, as the knob 22 is manually rotated, the damper 3 connected in turn to the rotating shaft 21 and the operating rod 4 is operated to open or close the diffuser 2. At the same time, the operating gear 213 of the rotating shaft 21 is rotated, and thus the first and second wheel 331 and 332 are cooperated with each other by means of the timing belt along with the third wheel 333, the indicator 30*a* is rotated to direct the scale on the indication scale portion 10*a*. Herein it is known that the invention enables a worker to confirm the opening or closing degree of the damper 3 by the scale value during the operating of the knob 22.

As described above, a damper opening/closing apparatus of a diffuser facilitates workers to adjust the opening or closing degree of a damper, thereby reducing a lot of the working time and labor in setting a blowing amount of air discharged from all diffuser in a building, efficiently.

What is claimed is:

1. An opening/closing apparatus of a diffuser comprising:

a case of a cylindrical form mounted at the center of a diffuser and including an indicating scale portion that has indicating scales formed along an arc adjacent to the outer front peripheral of the case;

a rotating manipulation portion including a rotating shaft which passes through the center portion of one surface of the case and is extended in a predetermined length out of the case, an operating gear portion integrally formed around the outer peripheral of the rotating shaft and a knob integrally fixed to one end of the rotating shaft which has an extending portion passing through the other surface of the case to be connected to an operating rode of the damper;

an indicating operation portion including an engaging gear of a larger diameter rotatably engaged with the operating gear, a shaft bearing having a center portion projected from the front surface of the case and an outer portion positioned adjacent to the front surface and an indicator coupled with the outer portion of the shaft bearing;

a driven wheel including first and second plain gears integrated to each other, in which the first and second plain gears each has a larger diameter and a smaller diameter to be engaged with the operating gear and the engaging gear, so that the indicator is rotated by the shaft bearing to direct the indicating scale on the indicating scale portion.

* * * * *